US009945059B2

(12) United States Patent
Gutierrez-Rosario

(10) Patent No.: US 9,945,059 B2
(45) Date of Patent: Apr. 17, 2018

(54) SEAM ALLOWANCE GUIDE AIDE

(71) Applicant: Ivonne T. Gutierrez-Rosario, Caguas, PR (US)

(72) Inventor: Ivonne T. Gutierrez-Rosario, Caguas, PR (US)

( * ) Notice: Subject to any disclaimer, the term of this patent is extended or adjusted under 35 U.S.C. 154(b) by 121 days.

(21) Appl. No.: 15/250,850

(22) Filed: Aug. 29, 2016

(65) Prior Publication Data

US 2016/0369442 A1 Dec. 22, 2016

Related U.S. Application Data

(63) Continuation-in-part of application No. 14/496,959, filed on Sep. 25, 2014, now Pat. No. 9,430,956.

(51) Int. Cl.

| | |
|---|---|
| ***D05B 35/10*** | (2006.01) |
| ***D05B 35/02*** | (2006.01) |
| ***D05B 35/12*** | (2006.01) |
| ***D05B 81/00*** | (2006.01) |
| *D05B 35/00* | (2006.01) |

(52) U.S. Cl.

CPC ..... *D05B 35/10* (2013.01); *D05B 35/02* (2013.01); *D05B 35/12* (2013.01); *D05B 81/00* (2013.01); *D05D 2205/12* (2013.01)

(58) Field of Classification Search

CPC ..... D05B 35/00; D05B 35/02; D05B 35/10; D05B 35/12; D05B 81/00; G09F 3/02; D05D 2205/12

See application file for complete search history.

(56) References Cited

U.S. PATENT DOCUMENTS

| | | | | | |
|---|---|---|---|---|---|
| 312,196 | A * | 2/1885 | Freeman | D05B 35/062 | 112/136 |
| 907,485 | A * | 12/1908 | Fellows | D05B 35/062 | 112/136 |
| 2,657,654 | A * | 11/1953 | Overman | D05B 5/02 | 112/136 |
| 2,788,759 | A * | 4/1957 | Peets | D05B 87/00 | 112/224 |
| 2,977,911 | A * | 4/1961 | Moore | D05B 35/02 | 112/260 |
| 3,071,091 | A * | 1/1963 | Erbland | D05B 73/12 | 112/260 |
| 3,392,691 | A * | 7/1968 | Pope | D05B 35/10 | 112/147 |
| 4,694,763 | A * | 9/1987 | Adams | D05B 73/12 | 112/184 |
| 4,748,925 | A * | 6/1988 | Takei | D05B 73/12 | 112/184 |
| 8,156,877 | B1 * | 4/2012 | Carr | D05B 35/10 | 112/117 |

* cited by examiner

*Primary Examiner* — Ismael Izaguirre

(74) *Attorney, Agent, or Firm* — Hoglund & Pamias, PSC; Roberto J. Rios

(57) ABSTRACT

A seam allowance guide aide system including a needle plate of a sewing machine containing vertical and horizontal lines with colors; a vertical line is provided to be aligned with the needle default position on the sewing machine. Colors are used to represent a standard measurement known and accepted in the sewing industry. The seam allowance guide aide is fixed and non-removable to said needle plate.

18 Claims, 9 Drawing Sheets

Caption for color lines

| ⅛" | ¼" | ⅜" | ½" | ⅝" | ¾" | |
|---|---|---|---|---|---|---|
| 3 | 6 | 9 | 12 | 15 | 18 | mm* |

The standard seam measurement is ⅝" (15mm or 1.5cm). It is the red line.

*Remember that 12mm = 1.2 cm, 15mm = 1.5 cm and so on.

SEAM ALLOWANCE GUIDE AIDE

FIELD OF THE INVENTION

This inventive subject matter relates to a seam allowance guide aide label—as in Sewing with Color Label—for accurate identification of standard measurements commonly worked in the sewing industry using color definitions for selecting the measurement line to place the edge of a fabric or textile to be sewn in the needle plate of a sewing machine. This seam allowance guide aide label—Sewing with Color Label—is to be applied to the sewing machine plate. The color lines printed on the label define with color the standard set measurements commonly used in today's sewing industry, defining that measurement with that color, as the others measurements are defined with different colors to specify a different measurement. Actual sewing machines have a plate with engraved lines to represent a standard set of measurements; all of these lines are the same width, color and length, making it difficult to determine the correct measurement line and maintaining accuracy during the process of sewing. Although some models have numerical representations to specify the measurement, they are only useful if you are fluent in numerical representations, leaving a non-numerical person, like a child with no knowledge of those representations, or the non-educated persons with serious doubts of where to place the edge of a fabric or textile to be sewn in the sewing machine, or to understand what's the difference between one line instead of another. This inventive seam allowance guide aide label—Sewing with Color Label—have imprinted vertical and horizontal color lines, which represent only one measurement per color, making it accurate to know that one color represent a specific measurement either in a vertical or horizontal line for a simple and accurate selection of a measurement in the process of placing the edge of a fabric or textile to be sewn in the sewing machine.

BACKGROUND OF THE INVENTION

The art of sewing with a sewing machine has improved immensely over the years. It has revolutionized eras, has altered and facilitate fashion for people around the world, has been a means of economic income to so many, but also it has been an equipment that can be used by those who can follow math instructions or for those who know or are educated enough to differentiate measurements. Therefore, it means math-oriented people old enough to understand numerical representations.

This inventive subject matter seam allowance guide aide label—Sewing with Color lines Label—sets and standardizes the use of color to represent the actual set standard sewing measurements used and represented in today's sewing machines. With the use of this color code representations many more people can sew without being troubled by not being math-oriented. With this seam allowance-guiding aide label young children, or not well educate people, and people with attention difficulties can be attracted to the use of colors instead of numbers. The representation of measurements with colors is easier to remember than the numerical system itself, especially for the not math-oriented. The introduction of sewing to children's and young people is easy as they will follow colors that are fast to choose and easy to remember.

This seam allowance guide aide label—Sewing with Color Label—can be used in new machines as well as in old ones that have no guides.

Over time sewers have been improving the quality and performance of their goods made with the sewing machine. But the sewers have to be persons with good understanding of the sewing process and numerical representations stated in the sewing machine. Since childhood many have been introduced to sew and sewing machines, but it has been difficult to explain where to place the edge of a fabric in the sewing machine to a person who knows nothing of the difference of a ⅝", 1.5 cm, seam line instead of the a ⅜", 1.0 cm, seam. This is the case of an adult trying to teach an 8 years old child. Imagine a factory employee that needs to achieve perfect sewing and control the exact measurement for each different piece. Lets remember the Home Economics courses, where the teachers tried very hard to explain the differences in the lines and the importance of not moving from one line to another. The ripping of seams has discouraged people from sewing, because it is not easy to identify one measurement line versus another. If a person doesn't know math, the lines means nothing except spaces. People educated in the imperial system often find the metric system cumbersome, and vice-versa. Further, if a person wants to follow written instructions, he/she needs to know some numerical representations.

Another cause of frustration is the confusion created by parallel and similar lines, that make them start in one of them and end their sewing at another line. Even experienced sewers have had some difficulties trying to control being on a specific measurement line when sewing long stitching lines.

Sewing in general can be encouraged, made fast and more accurately, using the Sewing with Color lines Label guide applied to the sewing machine needle plate, as the difference in a color of the measurement lines immediately acknowledge the sewing machine operator of a change in the measurement of the stitching line early enough in the process.

Actual sewing machines have engraved lines at the needle plate that represents specific measurements to place the edge of a fabric or textile to be sewn. These engraved lines are mostly equal in length and are all the same gray color in the metal plate of the sewing machine. The engraved lines improvement since U.S. Pat. No. 2,657,654, from Overman, et als, that established seam aligning means, innovated the sewing process in helping with guides where there were none at the time, but only few were able to understand numerical and math representation. In U.S. Pat. No. 5,027,727, from Ulmer, Christian, the guide is a component, that has good enough intention, but limits substantially the space in the arm of the sewing machine to maneuver with bulks of fabric. In U.S. Pat. No. 5,251,557, from Rohr, Günter, the guide device has to be realigned for every change in the desired seam allowance edge. Other sewing guides for specialty process as quilting, as in U.S. Pat. No. 7,318,384, from Gray, Sara, help only for the intended use, and has limited use in the sewing process.

Most of the seam allowance guides are for verticals stitching lines; the ones that have horizontal lines made the sewing plate a mix of crossing lines that far from helping in choosing the specific measurement create confusion in selecting the correct one.

The inventive—Sewing with Color Label—seam allowance guide label with the color chart description is a guide easy to explain to any person. If the person needs to place the edge of a fabric on the ⅝", 1.5 cm, line, the color chart description will define it as the vertical red line in the label. The person doesn't need to count for the appropriate line or look for numerical representations in this label. The operator is going to place the edge of the fabric in the red line and use it all the way until finishing the intended stitching line. If the operator sees a different color line it is an immediate indication to realign the stitching. Horizontal lines in the seam allowance guide aide label, Sewing with Color Label, are measurement guides for the bottom edge of the fabric or textile if the stitching must be stop, or for stop and pivoting to continue sewing at the same or other measurement line. If a decorative line around a piece is going to be stitched at ¼", 6 mm, from the edge of the fabric, the operator puts the edge of the fabric or textile in the black vertical line and will continue to sew until pass the black horizontal line appears at the bottom edge of the fabric, at which point the operator has to stop and pivot the fabric to the right until the black vertical line appears and continue stitching in the same measurement. No special measurements or markings in the fabric have to be made. Because the color represents the same measurement either vertical or horizontal, the person will only need to look the color chart to identify the color line that represents that measurement line, with complete certainty that the chosen color line is the measurement needed.

Any person will be able to sew reading an instruction guide looking to a numerical representation and finding the measurement at the Sewing with Color Label chart. Then, the person selects the color of the measurement line to place the edge of the fabric or textile on top of the Sewing with Color Label with the color code lines printed in it. The person will relate the numerical representation of the measurements with the color of the lines. This color code system will help to achieve great accuracy in projects.

SUMMARY OF THE INVENTION

The Sewing with Color Label is a color code seam allowance sewing guide aide label that defines and identifies with colors the selection of a measurement line due to the fact that each color represents only one measurement to precisely place the edge of a fabric or textile to be sewn in a sewing machine. The color implementation system for the standardization of colors for the common set measurements used in day-to-day sewing machines will eliminate confusion with instructions when identifying and selecting them in the sewing machine. The chosen color line represents only that measurement. The person will determine the line to use as indicated in an instruction sheet—the numerical representation—and identify the color line to be used to place the edge of the fabric in the chart that describes the color representations for the measurement. Any person can determine the color line to use with the chart to cue the color line. The use of colors for selection of a measurement line and to maintain stitching lines in the same measurement is the essential goal of this inventive subject matter, as it is noticeable any change in the color lines either to the right or to the left of any given line, pointing immediately the change to the operator or person to realign the edge of the fabric, if any change in color occurs.

Further and more important, it is how easy it will be to teach others, such as children, to follow colors, which will attract them more than numbers. People not capable of concentrating on numbers will find this a new way to discover that they can sew with control over colors as studies have demonstrated on this issue. Standard sewing measurements, either in inches or metric, are basically at the same point. For two persons sewing a similar piece, they only need to know the color to place the edge, no matter if they learn their measurements system in imperial system or metric. This Sewing with Color Label does not pretend to eliminate the use of measurements, but instead to facilitate the education and promotion of sewing among others that finds numerical representations difficult to follow. This pretends to make associations of colors to find the accuracy needed in sewing in order to achieve a good product. The quality of the products can improve with the use of this seam allowance sewing guide aide label; an additional benefit is to lower the effect of eyes strained for the person using it, as colors eases view over monochrome surfaces.

According to one aspect of the invention, a needle plate of a sewing machine is configured to contain a seam allowance guide aide according. The guide aide configuration is similar to the configuration of the label above described.

According to one aspect of the invention, the seam allowance guide aide is fixed and non-removable from the needle plate.

BRIEF DESCRIPTION OF THE DRAWINGS

FIG. 1-8 is the Color Chart or explanation for each line with a color definition in the Label.

FIG. 1-C—is the schematic bottom side view peeling off the backing that covers the glue material at the backside of the Label.

FIG. 2—is a schematic representation of a typical sewing machine with an exploded perspective of the needle plate that goes under the presser foot, #1.

FIG. 2A is an exploded front view representation of a typical needle plate with the measurement lines.

FIG. 2B is an exploded front view representation of the Sewing with Color Label applied on top of the needle plate as intended with this utility invention.

FIG. 3—is a schematic representation of the process of aligning the Sewing with Color Label, aligning the first vertical line with the needle at the default position of the sewing machine to obtain the benefits of this utility invention.

FIG. 4—is the schematic view for peeling out a corner of the backing of the label to be placed on the surface of the needle plate once the first vertical line of the label has been aligned to the needle in the plate of a sewing machine.

FIG. 5—is the schematic view when the label has been aligned and completely applied to the surface of the plate of a sewing machine.

FIG. 6—is the schematic view of a needle plate of a sewing machine containing a seam allowance guide aide, according to an embodiment of the invention.

FIG. 7—is the schematic view of a needle plate of a sewing machine containing a seam allowance guide aide, according to an embodiment of the invention.

FIG. 8—is the schematic view of a needle plate of a sewing machine containing a seam allowance guide aide, according to an embodiment of the invention.

DETAILED DESCRIPTION OF THE INVENTION

Figures 1A, 1B:
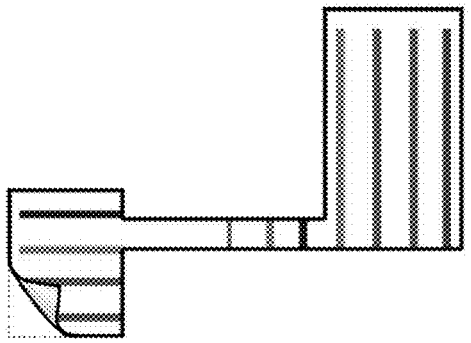
FIG. 1-A is a schematic front view of the Sewing with Color Label with the colors used to represent measurement.
Figure 1C:
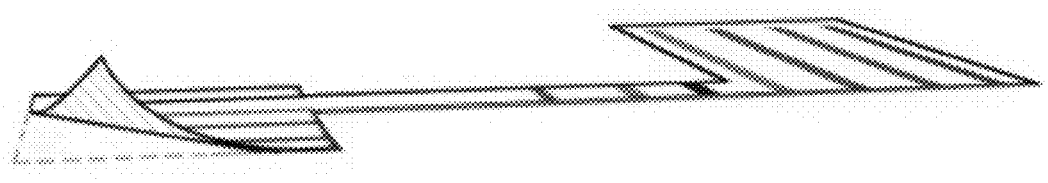

FIG. 1A represents the Sewing with Color Label in which each color line is different in order to accurately determine the line needed for sewing, once the color chart has been observed. The same color line represents a specific measurement either in vertical or horizontal line. The first vertical line—fuchsia color—is the line to be used to align the label for placement in the plate of the sewing machine. The fuchsia vertical line is to be aligned with the needle. The following vertical color lines represent the standard sewing measurement used in day-to-day sewing, in increments of ⅛"-3 mm -with the colors applied to the measurement lines. The horizontal lines at the bottom left side of the fuchsia vertical line—or line of alignment—represent a set of lines to help sewers with colors that represent measurements for the benefit of the sewer to stop sewing or to stop and pivot at a specific measurement when the lower edge of the fabric or textile reaches the horizontal color line that specifies the measurement needed. These lines help determine a distance or measurement, either to stop a stitching line at the bottom of a fabric, or to stop and turn and continue stitching. A line with a specific color either in the vertical or horizontal position represents the same measurement. If the operator needs to stitch a ½"-1.2 cm—seam allowance and stop and turn to continue stitching, he or she will only need to focus on the green vertical line and stop after the green horizontal line appears at the bottom edge of the fabric, to stop, pivot and continue stitching in the same measurement green vertical line.

The colors used in each measurement representation have reference in other situations in life. Example: ⅝" or 1.5 cm is the standard measurement used to sew or as referred to standard seam allowance. Taking this information into account, when sewing a regular piece, the edge of the fabric must not be past this measurement, and that is the reason to designate red as the color for this ⅝" or 1.5 cm, because there are many signs in which red is designated to stop or not to go beyond that point. If a person who is sewing moves to the right of this line, he or she will easily notice the change in color and can rearrange the stitching line. The orange line is used to designate the ⅜" or 1 cm line, which is the least amount of seam allowance to stitch in a piece. Orange represents caution in many elements of life. Green is associated with "go ahead", and for that reason it is used to represent the ½" or 1.2 cm line which is a confortable seam allowance and safe for day-to-day use in wardrobes pieces.

Studies have shown that making correlations of objects or locations with colors accelerates learning. This inventive Sewing with Color Label pretends to help people identify markings and the meaning of them just by looking to a color. When an adult is trying to teach a youngster to sew asking them to sew in a ⅝" or 1.5 cm seam allowance is not an easy task, but instead telling them that whenever they look in a sewing instruction guide for that number, it means to use the red line it will be easier to explain. The Caption Color Chart as in FIG. 1B, is an explanation or correlation of the colors to a measurement, which give the sewer, a child or an adult, the ability to read a sewing instruction with ease. The colors have numerical representations in imperial and metric systems. An example has been added as clarification for the user. This Color Chart Definition of the Label will be translated to different languages.

Figure 2:
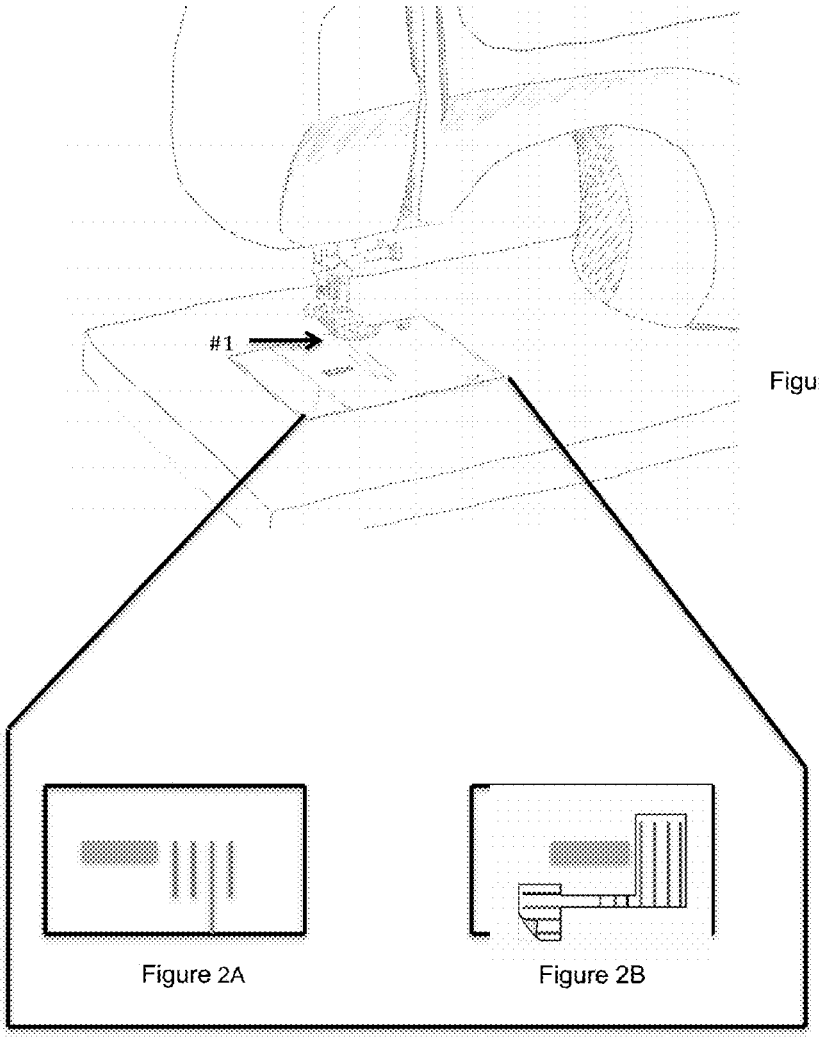
Figure 3:
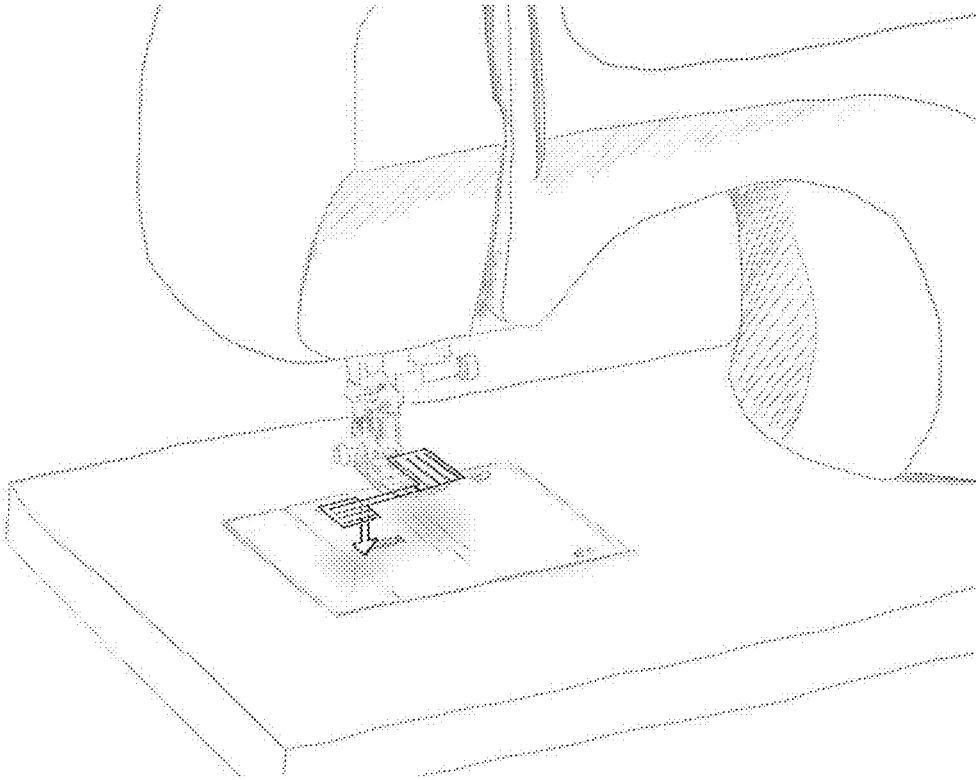
Figure 4:
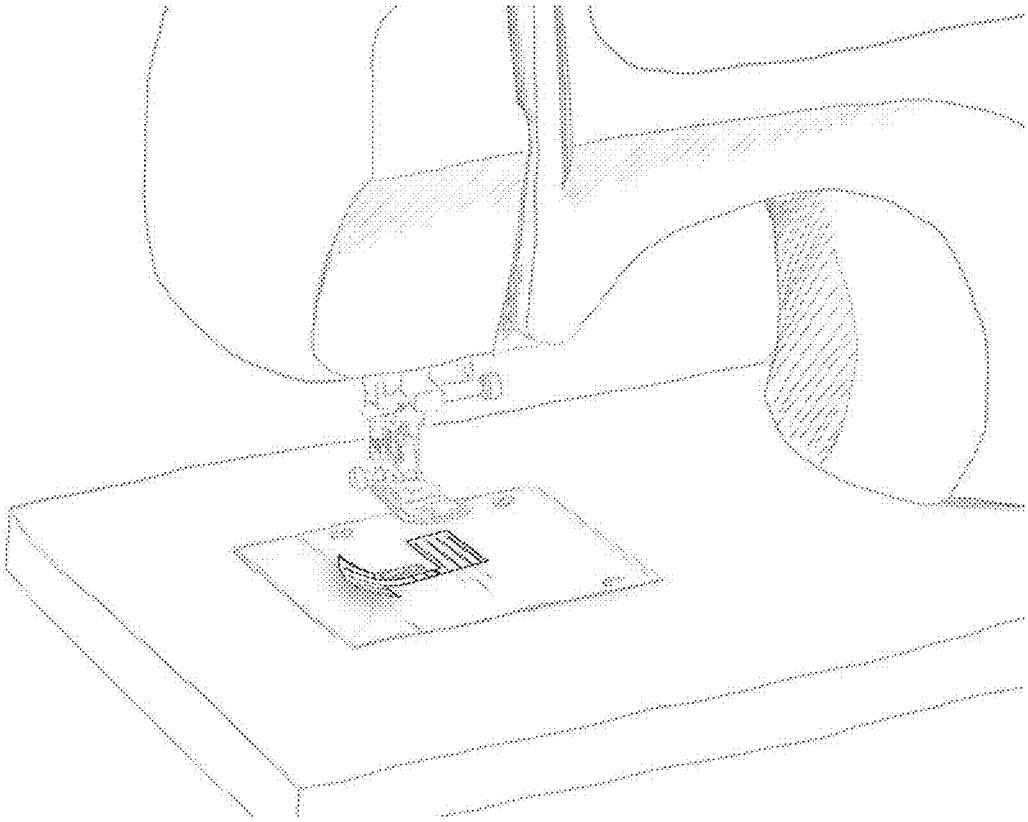

Understanding the location of the needle plate is important, as it is in this area that this inventive sewing guide aide label will be a reference point to apply the label to the sewing machine. This is the intention of FIG. 2, in which a top front view is presented with amplification of the needle plate, as in FIG. 2A; and the intended placement of the invention of the Sewing with Color Label in the needle plate as in FIG. 2B. In the process of applying the Label to the needle plate, the presser foot, FIG. 2, #1, should be removed to make it easy and precise. Without the presser foot, a person has complete view of the needle plate, especially the needle that is the main aligning reference point, as viewed in FIG. 3. Once the Sewing with Color Label is presented in the precise location and the Sewing with Color Label applied to the surface of the sewing machine, the presser foot can be put back in place, FIG. 4. The Label is designed so that no interference is made with the feed dogs movements; it will lay-away and around them. In some rare cases, extra cutting may be needed if the top bobbin flap is close to the feed dogs, in that instance any cutting device such as a little knife can be used to trim this job.

Figure 5:
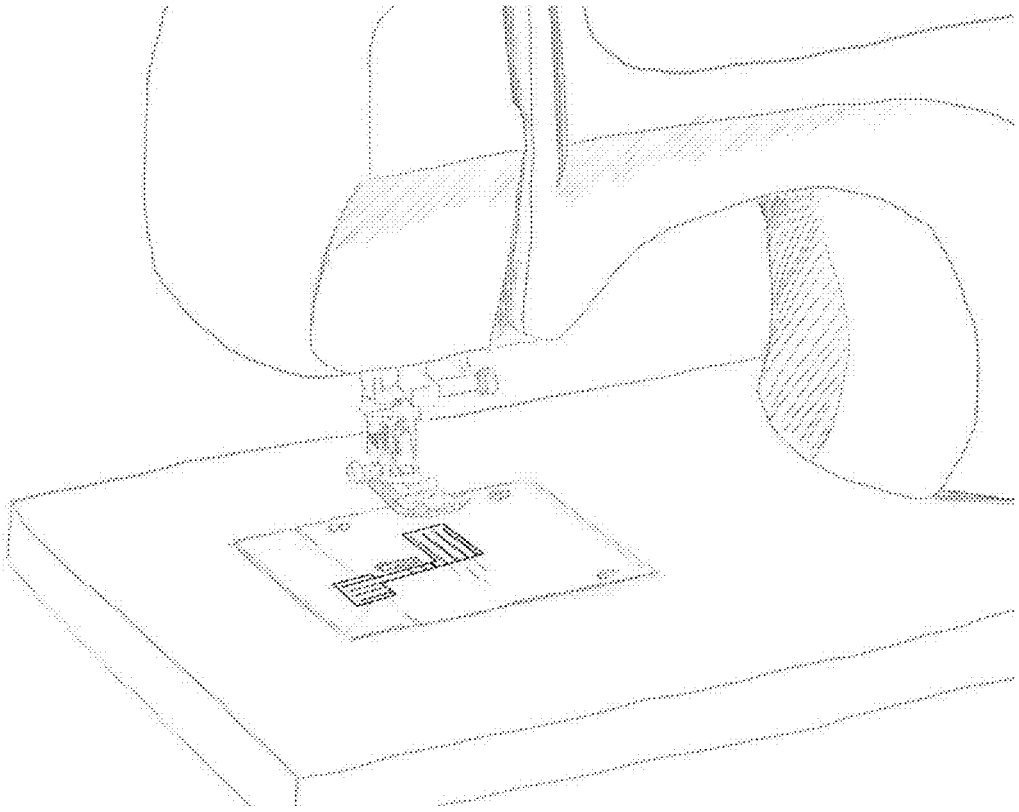

After the Label is completely applied it won't affect the sliding of the fabric over the plate, as it is a very thin layer of paper. FIG. 5 shows the label being completely applied over the needle plate of the sewing machine.

The seam allowance guide aide of the present invention can also be fixed or embedded onto the surface of the needle plate. In other words the shape, lines and color configuration of the above-described label can be integrated into the upper surface of the needle plate in a non-removable manner. For example, the guide aide can be engraved, embossed, etched or printed on the surface of said needle plate. Other fixing means or methods can also be used as long as the guide aide arrangement is fixed, non-removable and part of said needle plate.

Figure 6:
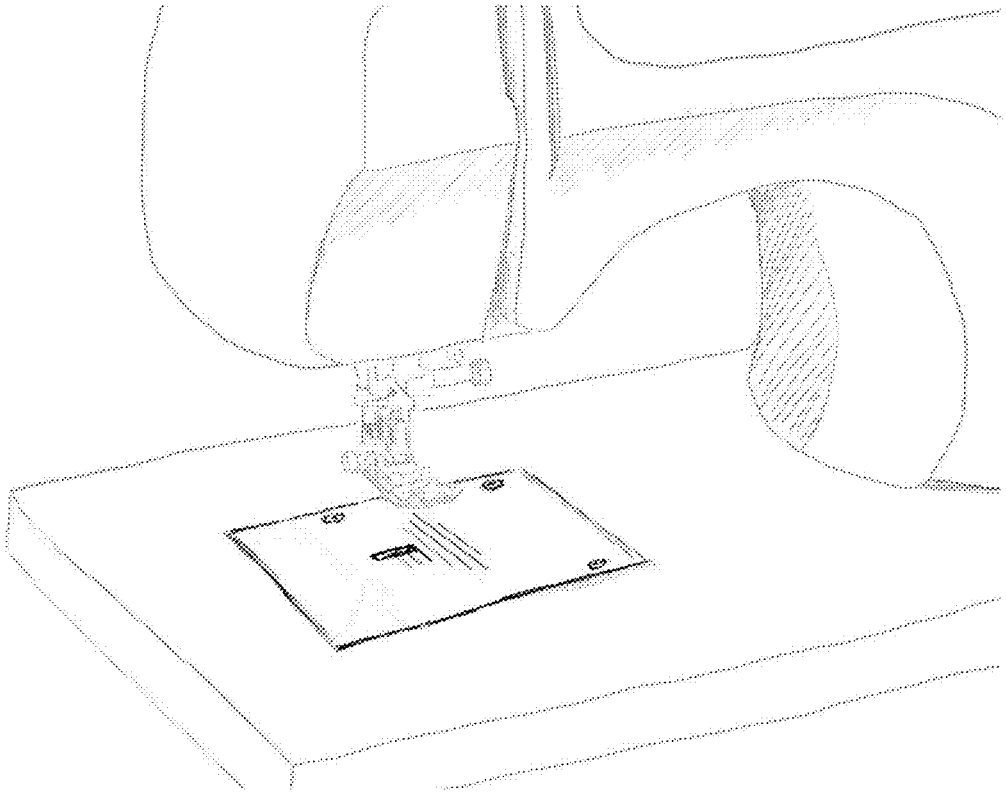
Figure 7:
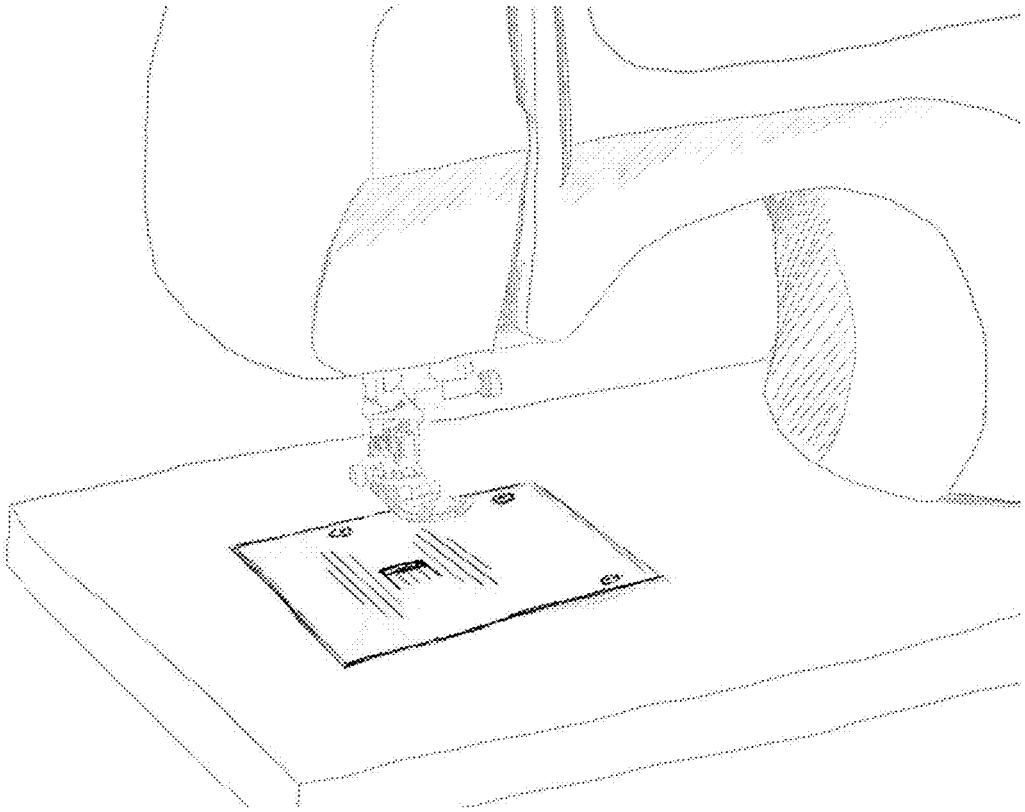
Figure 8:
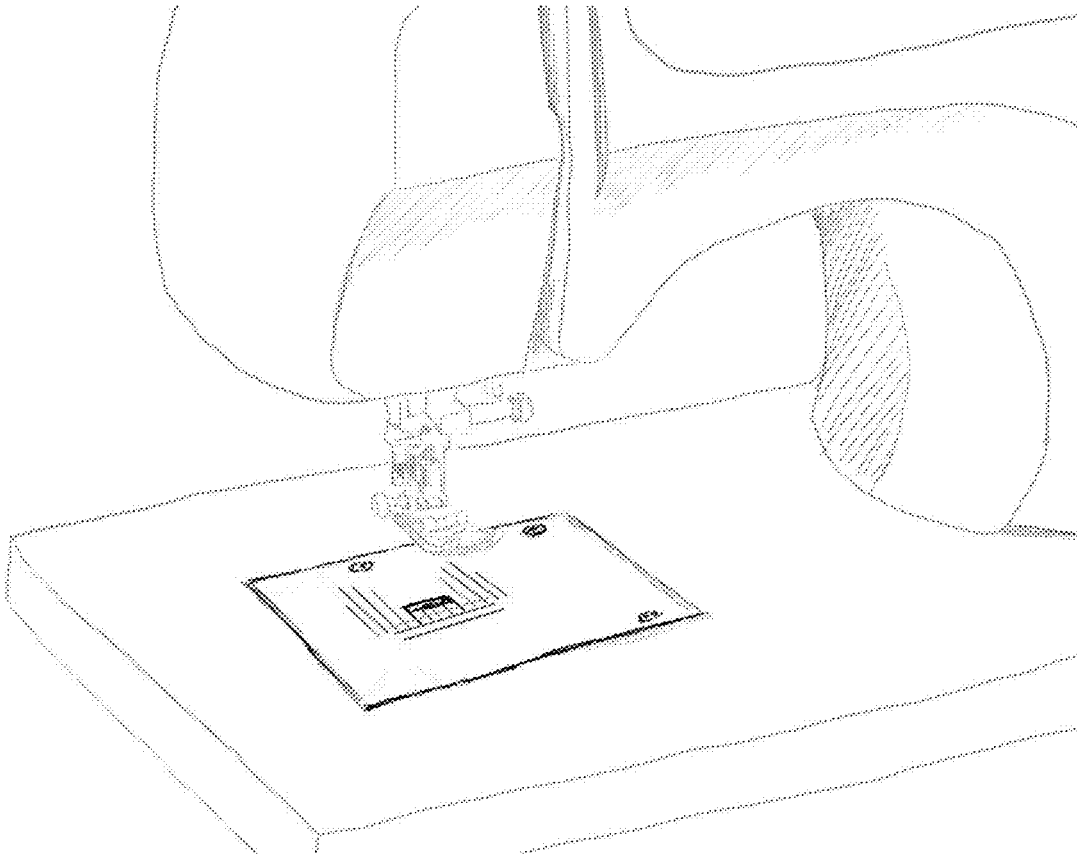

FIGS. 6-8 show a schematic view of an alternate embodiment of the needle plate containing the fixed and non-removable seam allowance guide aide. Specifically, FIG. 8 shows an embodiment having a guide aide part including a middle portion, a left portion, a right portion and a bottom portion. As can be appreciated, each of the left portion, the right portion and the bottom portion has colored lines each representing the standard sewing measurement used in day-to-day sewing in accordance with the invention. Moreover, the lines can have different lengths, as shown in the Figure, or the same length. The middle portion includes an aligning line aligned with the needle of the sewing machine. In addition, the middle portion can include additional lines also representing the standard sewing measurement used in day-to-day sewing.

Although the present invention has been described herein with reference to the foregoing exemplary embodiment, this embodiment does not serve to limit the scope of the present invention. Accordingly, those skilled in the art to which the present invention pertains will appreciate that various modifications are possible, without departing from the technical spirit of the present invention.

I claim:

1. A seam allowance guide aide for a sewing machine comprising:

a needle plate configured to be used on a sewing machine, said needle plate having a guide aide containing:

a first four-sided portion having a first top border, a first bottom border, a first right border and a first left border, wherein a first plurality of seam allowance linear indicia is provided on said first four-sided portion, said plurality of seam allowance linear indicia longitudinally extending between said first top border and said first bottom border and being parallel to said first right border and said first left border, a second four-sided portion having a second top border, a second bottom border, a second right border and a second left border, wherein said second right border comprises a portion of said first left border closest to said first bottom border a third four-sided portion having a third top border, a third bottom border, a third right border and a third left border, wherein a second plurality of seam allowance linear indicia is provided on said third four-sided portion and positioned perpendicular in relation to said first plurality of seam allowance linear indicia, said third right border comprises a portion of said second left border closest to said second top border;

each of said first plurality of seam allowance linear indicia is assigned a different color and each of said linear indicia of said second plurality of seam allowance linear indicia corresponds to a color assigned to said first linear indicia on a one-on-one basis.

2. The seam allowance guide aide of claim 1, wherein each color corresponds to a predefined measurement distance.

3. The seam allowance guide aide of claim 1, wherein an aligning linear indicia is provided on said second four-sided portion, said aligning linear indicia being aligned with a needle position of a sewing machine.

4. The seam allowance guide aide of claim 2, wherein said first plurality of seam allowance linear indicia is equidistant to each other.

5. The seam allowance guide aide of claim 2, wherein said second plurality of seam allowance linear indicia is equidistant to each other.

6. The seam allowance guide aide of claim 1, wherein said first plurality of seam allowance linear indicia extends onto said second four-sided portion.

7. The seam allowance guide aide of claim 1, wherein each linear indicia of said first plurality of seam allowance linear indicia represents a measurement.

8. The seam allowance guide aide of claim 7, wherein said measurement is sequentially incremented throughout said first plurality of seam allowance linear indicia.

9. The seam allowance guide aide of claim 8, wherein said measurement is incremented in inches.

10. The seam allowance guide aide of claim 8, wherein said measurement is incremented in mm.

11. The seam allowance guide aide of claim 1, wherein the area of said first four-sided portion is greater than the area of said second four-sided portion and said third four-sided portion.

12. The seam allowance guide aide of claim 1, wherein the area of said second four-sided portion is lesser than the area of said first four-sided portion and said third four-sided portion.

13. The seam allowance guide aide of claim 1, wherein the area of said third four-sided portion is lesser than the area of said first four-sided portion and greater than the area of said second four-sided portion.

14. The seam allowance guide aide of claim 1, wherein said first plurality of seam allowance linear indicia never intersects said second plurality of seam allowance linear indicia.

15. The seam allowance guide aide of claim 1, wherein the length of said first plurality of seam allowance linear indicia is different than the length of said second plurality of seam allowance linear indicia.

16. The seam allowance guide aide of claim 1, wherein said guide aide is removable from said needle plate.

17. The seam allowance guide aide of claim 1, wherein said guide aide is fixed onto said needle plate.

18. The seam allowance guide aide of claim 17, wherein said guide aide is fixed by at least one of: engraving, embossing, etching, and printing.

* * * * *